US009520093B2

(12) United States Patent
Chen

(10) Patent No.: US 9,520,093 B2
(45) Date of Patent: Dec. 13, 2016

(54) LIQUID CRYSTAL DISPLAY DEVICE AND DRIVING METHOD THEREOF

(71) Applicant: Shenzhen China Star Optoelectronics Technology Co., Ltd., Shenzhen, Guangdong (CN)

(72) Inventor: Lixuan Chen, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 33 days.

(21) Appl. No.: 14/428,361

(22) PCT Filed: Jan. 20, 2015

(86) PCT No.: PCT/CN2015/071127

§ 371 (c)(1),
(2) Date: Mar. 14, 2015

(87) PCT Pub. No.: WO2016/095317

PCT Pub. Date: Jun. 23, 2016

(65) Prior Publication Data

US 2016/0210911 A1 Jul. 21, 2016

(30) Foreign Application Priority Data

Dec. 16, 2014 (CN) ..... 2014 1 0784095

(51) Int. Cl.
*G09G 3/36* (2006.01)

(52) U.S. Cl.
CPC ..... *G09G 3/3607* (2013.01); *G09G 3/3611* (2013.01); *G09G 2300/0421* (2013.01); *G09G 2310/08* (2013.01); *G09G 2320/0242* (2013.01); *G09G 2340/06* (2013.01)

(58) Field of Classification Search
None
See application file for complete search history.

(56) References Cited

U.S. PATENT DOCUMENTS

2014/0211128 A1* 7/2014 Yang ..... G02F 1/133514 349/68

FOREIGN PATENT DOCUMENTS

CN 102472907 A 5/2012

* cited by examiner

*Primary Examiner* — Kenneth B Lee, Jr.
(74) *Attorney, Agent, or Firm* — Andrew C. Cheng

(57) ABSTRACT

The disclosure relates to a driving method of liquid crystal display panel. The liquid crystal display panel comprises a plurality of display units, the display unit comprises two adjacent pixel units. Wherein the driving method comprises: receiving input video data; determining that whether the input video data are within a plurality of video data intervals of predetermined complexion frame; if the input video data is within a certain video data intervals of predetermined complexion frame, then obtain high video data and low video data according to the input video data; providing the high video data to one of the pixel units, and providing the low video data to the other pixel units. The disclosure also relates to a liquid crystal display panel driven by the driving method.

16 Claims, 2 Drawing Sheets

LIQUID CRYSTAL DISPLAY DEVICE AND DRIVING METHOD THEREOF

BACKGROUND

Technical Field

The disclosure relates to the technology field of liquid crystal display, and more particularly, to a liquid crystal display panel and a driving method thereof.

Related Art

With the evolution of photoelectric and semiconductor technology, the flat panel display has been developed flourishly. In flat panel displays, liquid crystal displays (LCD) have become the mainstream products in the market because of their advantages, such as high efficiency of space utilization, low power consumption, radiation-free and low electromagnetic interference. Currently, the wide view angle is one of the most important technic to be developed. However, when the view angle is too large, the liquid crystal display with wide view angle would meet the problem of color shift.

In order to solve the problem of color shift in the liquid crystal displays with wide view angle, the industry has adopted a technique named as 2D1G. The technique of 2D1G indicates that: in the liquid display panel, each of the pixel units is divided into main pixels and sub pixels with different areas. The main pixel and the sub pixel in the same pixel unit connect to different data lines and the same gate line. The problem of color shift when the view angle in too large is solved by inputting different data signals (i.e. different gray scale values) to the main pixel and the sub pixel so as to generate different brightness of display and brightness of oblique view.

However, the amount of the data lines of the input data signals is doubled when each of the pixel units is divided into a main pixel and a sub pixel. Thus, the aperture ratio of the liquid display panel is greatly lowered, and the transmittance of the liquid display panel is affected, so that the performance of the liquid display panel is deteriorated.

SUMMARY

In order to solve the above current technique problem, an object of the disclosure provides a driving method of liquid crystal display panel, the liquid crystal display panel comprises a plurality of display units, and the display unit comprises two adjacent pixel units. Wherein the driving method comprises: receiving input video data; determining that whether the input video data are within a plurality of video data intervals of predetermined complexion frame; if the input video data is within a certain video data intervals of predetermined complexion frame, then obtain high video data and low video data according to the input video data; providing the high video data to one of the pixel units, and providing the low video data to the other pixel units.

Further, if the input video data is not within any of the video data intervals of predetermined complexion frame, then provide the input video data to the pixel units.

Further, the input video data comprise input red gray scale values, input green gray scale values and input blue gray scale values, the plurality of video data intervals of predetermined complexion frame comprises intervals of red gray scale values, intervals of green gray scale values and intervals of blue gray scale values. Wherein the input video data being within a certain video data interval of predetermined complexion frame indicates that: the input red gray scale value is within a certain red gray scale interval of predetermined complexion frame, the input green gray scale value is within a certain green gray scale interval of predetermined complexion frame, and the input blue gray scale value is within a certain blue gray scale interval of predetermined complexion frame.

Further, the input video data comprise input red gray scale values, input green gray scale values and input blue gray scale values, the plurality of video data intervals of predetermined complexion frame comprises intervals of red gray scale values, intervals of green gray scale values and intervals of blue gray scale values. Wherein the input video data being not within any of the intervals of predetermined complexion frame indicates that: the input gray scale values of at least one color is not within any of the corresponding gray scale intervals of predetermined complexion frame.

Further, the liquid crystal display panel further comprises a lookup table, the lookup table comprises a plurality of video data, and high video data and low video data, the high video data and the low video data are divided from the video data. Wherein the step of obtaining corresponding high video data and low video data according to the input video data is: obtaining corresponding high video data and low video data of the input video data by finding the lookup table according to the input video data.

Further, the high video data and the low video data are divided from the video data according to Formula 1, $$\Delta(H, L) = \frac{\mathrm{abs}(L\nu\alpha(H) + L\nu\alpha(L) - L\nu\alpha(T))}{L\nu\alpha(T)}, \quad \text{[Formula 1]}$$

$$\Delta(H, L) < S,$$

$$e(H, L) = (x_\beta(H, L) - x_\alpha)^2 + (y_\beta(H, L) - y_\alpha)^2,$$

wherein obtain a minimum value from e(H,L), T indicates the video data, H indicates the high video data corresponding to the video data, L indicates the low video data corresponding to the video data, S indicates a predetermined threshold S, $L\nu\alpha(H)$ indicates the corresponding brightness value of the image displayed by the video data T and the high video data H under a front view angle $\alpha$, $L\nu\ \alpha(L)$ indicates the corresponding brightness value of the image displayed by the video data T and the low video data L under the front view angle $\alpha$, $L\nu\alpha(T)$ indicates the brightness value of the image displayed by the video data T under the front view angle $\alpha$, $x_\beta(H,L)$ and $y_\beta(H,L)$ indicate the chromaticity coordinates in CIE1931 system of the image displayed by the video data T under an oblique view angle $\beta$, as well as $x_\alpha$ and $y_\alpha$ indicates the chromaticity coordinates in CIE1931 system of the image displayed by the video data T under the front view angle $\alpha$.

Further, the range of the predetermined threshold S is between 0.05 and 0.1

Further, the front view angle $\alpha$ is 0°, and the oblique view angle $\beta$ is between 30° and 80°.

Further, the oblique view angle $\beta$ is 60°.

Another object of the disclosure provides a liquid crystal display panel, comprising a gate controller, a source controller and a pixel unit, the gate controller providing a scanning signal to the pixel unit by scan lines, the source controller providing a data signal to the pixel unit by data lines. The liquid crystal display panel is driven by the driving method.

According to the liquid crystal display panel and the driving method thereof of the disclosure, the input video data are transformed into high video data and low video data according to the predetermined complexion frame, and the high video data and the low video data are provided to the two adjacent pixel units, so that the visual effect of the liquid crystal display panel with a large view angle is improved in certain frame areas while remaining resolution and the signal unchanged when displaying other images. In addition, the problem of color shift when the view angle is too large is solved, the aperture ratio needs not to be lowered, and the performance of the liquid display panel is improved.

BRIEF DESCRIPTION OF THE DRAWINGS

The above and other exemplary aspects, features and advantages of certain exemplary embodiments of the present disclosure will be more apparent from the following description taken in conjunction with the accompanying drawings, in which.

DETAILED DESCRIPTION

The following description with reference to the accompanying drawings is provided to explain the exemplary embodiments of the disclosure. It will be apparent, however, that the disclosure may be practiced by one or more embodiments, and the specific embodiments provided herein cannot be interpreted to limit the disclosure. On the contrary, those embodiments are provided to explain the principle and the application of the disclosure such that those skilled in the art may understand the various embodiments of the disclosure and the various modifications for specific expected application.

Figure 1:
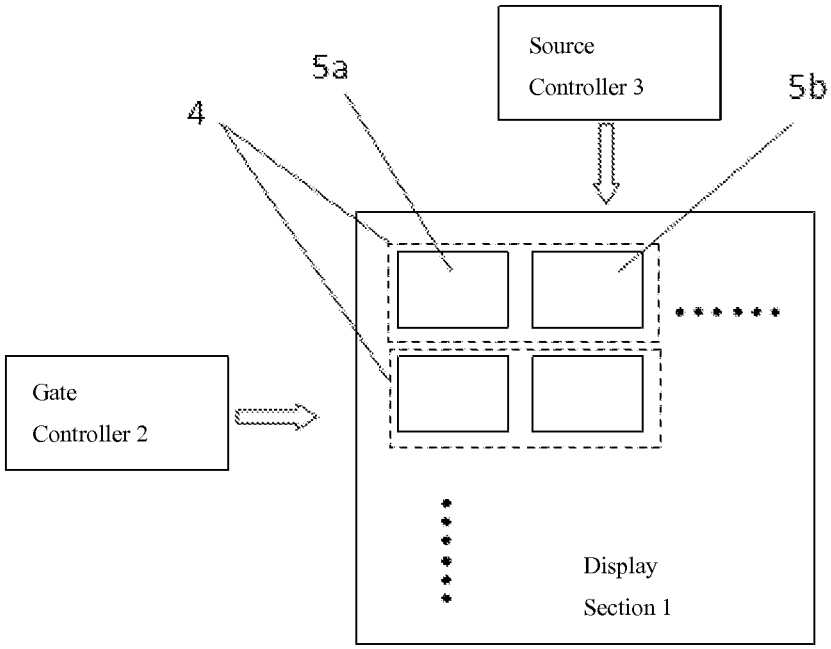
FIG. 1 is a schematic view of the liquid crystal display panel according to the embodiment of the disclosure.
Figure 2:
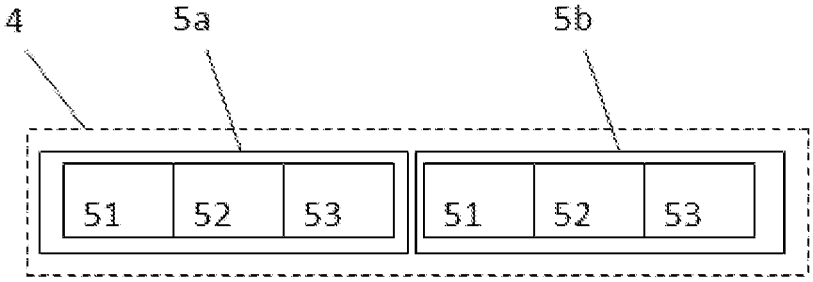
FIG. 2 is a schematic diagram of the display unit divided in the liquid crystal display panel according to the embodiment of the disclosure.

FIG. 1 is a schematic view of the liquid crystal display panel according to the embodiment of the disclosure. FIG. 2 is a schematic diagram of the display unit divided in the liquid crystal display panel according to the embodiment of the disclosure.

Refer to FIGS. 1 and 2, a liquid crystal display panel of the disclosure comprises: a display section 1, a source controller 2, a pixel unit 3 and a lookup table (not shown).

The display section is divided in to a plurality of display units 4. Wherein each of the display units 4 comprises a first pixel unit 5*a* and a second pixel unit 5*b*, and the first pixel unit 5*a* is adjacent to the second pixel unit 5*b*. The first pixel unit 5*a* and the second pixel unit 5*b* both have a red sub pixel 51, a green sub pixel 52 and a blue sub pixel 53. The gate controller 2 provides a scanning signal to each of the pixel units 5*a*, 5*b* by scan lines (not shown). The source controller 3 provides a video data (i.e. data signal) to each of the pixel units 5*a*, 5*b* by data lines (not shown).

Figure 3:
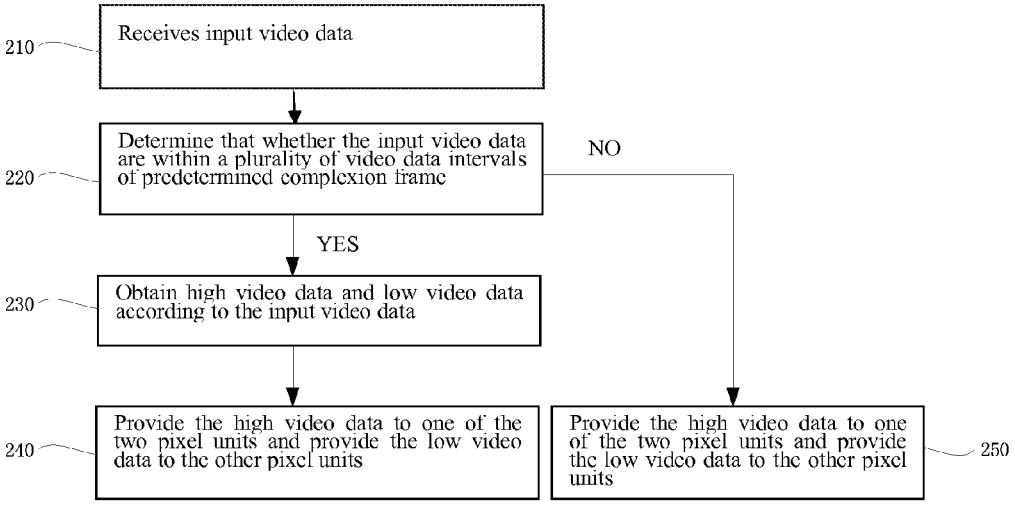
FIG. 3 is a flow chart of the driving method of liquid crystal display panel according to the embodiment of the disclosure.

FIG. 3 is a flow chart of the driving method of liquid crystal display panel according to the embodiment of the disclosure.

Refer to FIGS. 1 to 3, the driving method of liquid crystal display panel according to the embodiment of the disclosure comprises:

Step 210: the liquid crystal display panel receives input video data. The input video data comprises input red gray scale values, input green gray scale values and input blue gray scale.

Step 220: determine that whether the input video data are within a plurality of video data intervals of predetermined complexion frame. The plurality of video data intervals of predetermined complexion frame comprises intervals of red gray scale values, intervals of green gray scale values and intervals of blue gray scale values. Table 1 indicates the video data of the predetermined complexion frame.

TABLE 1

| Serial number of the predetermined complexion frame | 0~255 Region set of the gray scale (Analog Interface) | | | 16~235 Region set of the gray scale (Digital Interface) | | |
|---|---|---|---|---|---|---|
| | Red gray scale values | Green gray scale values | Blue gray scale values | Red gray scale values | Green gray scale values | Blue gray scale values |
| 1 | 115 | 82 | 68 | 115 | 87 | 74 |
| 2 | 194 | 150 | 130 | 183 | 145 | 128 |
| 3 | 56 | 61 | 150 | 64 | 69 | 145 |
| 4 | 70 | 148 | 73 | 76 | 143 | 79 |
| 5 | 175 | 54 | 60 | 166 | 62 | 68 |
| 6 | 231 | 199 | 31 | 214 | 187 | 43 |
| 7 | 187 | 86 | 149 | 177 | 90 | 143 |
| 8 | 8 | 133 | 161 | 23 | 130 | 154 |
| 9 | 122 | 122 | 121 | 121 | 121 | 120 |

Take the first predetermined complexion frame in the analog interface as an example (i.e. the serial number of the predetermined complexion frame is 1), the red gray scale values are (a*115, b*115), the green gray scale values are (a*82, b*82), and the blue gray scale values are (a*68, b*68), wherein a is smaller than 1 and b is greater than 1.

If the input video data is within a certain video data intervals of predetermined complexion frame, then Step 230 and Step 240 is performed. Wherein the input video data are within a certain video data interval of predetermined complexion frame indicates that: the input red gray scale value is within a certain red gray scale interval of predetermined complexion frame, the input green gray scale value is within a certain green gray scale interval of predetermined complexion frame, and the input blue gray scale value is within a certain blue gray scale interval of predetermined complexion frame.

If the input video data is not within any of the video data intervals of predetermined complexion frame, then Step 250 is performed. Wherein the input video data being not within any of the intervals of predetermined complexion frame indicates that: the input gray scale values of at least one color (i.e. the red gray scale value, the green gray scale value or the blue gray scale value) is not within any of the corresponding gray scale intervals of predetermined complexion frame.

Step 230: obtain high video data and low video data according to the input video data. A plurality of video data, high video data and low video data are stored in the lookup table of the liquid crystal display panel, and the high video data and the low video data are divided from each of the video data. In the embodiment, 256 (0~255) video data are stored in the lookup table of the liquid crystal display panel. The video data are gray scale values of different colors. In other words, 256 red gray scale values, 256 green gray scale values, 256 blue gray scale values, the high red gray scale values and the low red gray scale values divided from the red gray scale values, the high green gray scale values and the low green gray scale values divided from the green gray scale values, as well as the high blue gray scale values and the low blue gray scale values divided from the blue gray scale values are stored in the lookup table 4 of the liquid crystal display panel.

In Step 230, the high video data and the low video data are divided from the video data according to Formula 1, $$\Delta(H, L) = \frac{\mathrm{abs}(L\nu\alpha(H) + L\nu\alpha(L) - L\nu\alpha(T))}{L\nu\alpha(T)}, \quad \text{[Formula 1]}$$

$$\Delta(H, L) < S,$$

$$e(H, L) = (x_\beta(H, L) - x_\alpha)^2 + (y_\beta(H, L) - y_\alpha)^2,$$

wherein obtain a minimum value from e(H,L), T indicates the video data, H indicates the high video data corresponding to the video data, L indicates the low video data corresponding to the video data, S indicates a predetermined threshold S, $L\nu\alpha(H)$ indicates the corresponding brightness value of the image displayed by the video data T and the high video data H under a front view angle $\alpha$, $L\nu\alpha(L)$ indicates the corresponding brightness value of the image displayed by the video data T and the low video data L under the front view angle $\alpha$, $L\nu\alpha(T)$ indicates the brightness value of the image displayed by the video data T under the front view angle $\alpha$, $x_\beta(H,L)$ and $y_\beta(H,L)$ indicate the chromaticity coordinates in CIE1931 system of the image displayed by the video data T under an oblique view angle $\beta$, as well as $x_\alpha$ and $y_\alpha$ indicates the chromaticity coordinates in CIE1931 system of the image displayed by the video data T under the front view angle $\alpha$.

Wherein, the range of the predetermined threshold S is between 0.05 and 0.1. The front view angle $\alpha$ is 0°, and the oblique view angle $\beta$ is between 30° and 80°.

Each of the red gray scale values can be divided into a high red gray scale value and a low red gray scale value, each of the green gray scale values can be divided into a high green gray scale value and a low green gray scale value, as well as each of the blue gray scale values can be divided into a high blue gray scale value and a low blue gray scale value according to the above Formula 1.

Step 240: the source controller 3 provides the high video data, which are found from the lookup table according to the input video data, to one of the first pixel unit 5*a* and the second pixel unit 5*b*, as well as the source controller 3 provides the low video data, which are found from the lookup table according to the input video data, to the other of the first pixel unit 5*a* and the second pixel unit 5*b*.

Step 250: the source controller 3 provides the input video data to each of the pixel units 5*a*, 5*b* directly.

Figure 4:
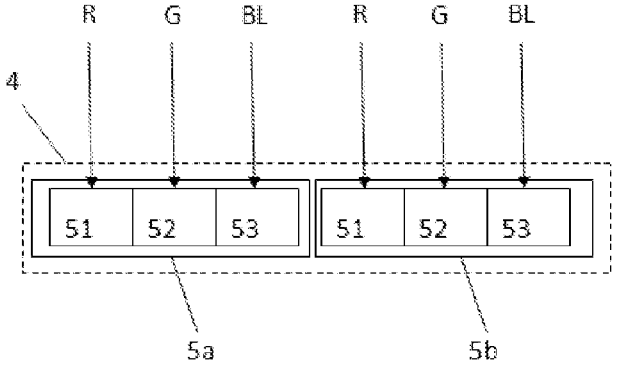
FIG. 4 is a schematic diagram of providing video data to the display unit in the driving method of liquid crystal display panel according to the embodiment of the disclosure.
Figure 5:
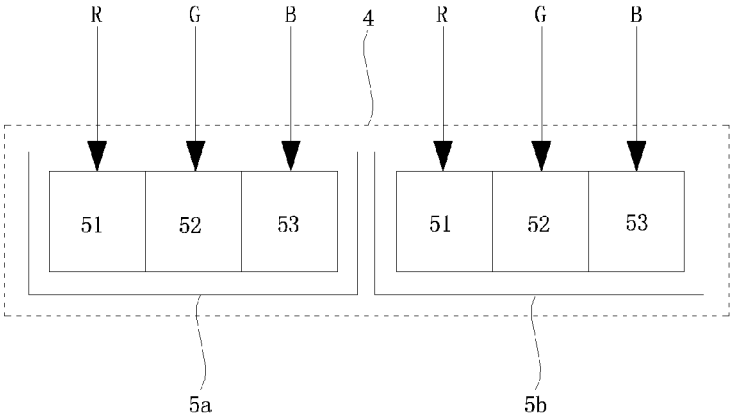
FIG. 5 is another schematic diagram of providing video data to the display unit in the driving method of liquid crystal display panel according to the embodiment of the disclosure.

The following describes the driving method of liquid crystal display panel of the disclosure, wherein the embodiment is described with the front view angle $\alpha$ being 0° and the oblique view angle $\beta$ being 60° under the first predetermined complexion frame in the analog interface, while a is 0.9 and b is 1.1. Wherein, for the input video data, only the blue gray scale values are divided, but the disclosure is not limited thereto. For example, the gray scale values of at least one color can be divided according to the users' needs. FIG. 4 is a schematic diagram of providing video data to the display unit in the driving method of liquid crystal display panel according to the embodiment of the disclosure. FIG. 5 is another schematic diagram of providing video data to the display unit in the driving method of liquid crystal display panel according to the embodiment of the disclosure.

Refer to FIG. 3 to FIG. 5, firstly the liquid crystal display panel receives input video data. The input video data comprises red gray scale values R, green gray scale values G and blue gray scale values B.

Then, determine that whether the input video data are within a plurality of video data intervals of predetermined complexion frame. The plurality of video data intervals of predetermined complexion frame comprises intervals of red gray scale values, intervals of green gray scale values and intervals of blue gray scale values.

Wherein, take the first predetermined complexion frame in the analog interface as an example, the red gray scale values are (0.9*115, 1.1*115), the green gray scale values are (0.9*82, 1.1*82), and the blue gray scale values are (0.9*68, 1.1*68).

If 0.9*115<R<1.1*115, 0.9*82<G<1.1*82, as well as 0.9*68<B<1.1*68, the input video data are within the video data intervals of the first predetermined complexion frame, then the corresponding high video data and the low video data are obtained according to the input video data. Since only blue gray scale values are divided in the embodiment, corresponding high blue gray scale values BH and low blue gray scale values BL are found from the lookup table according to the input blue gray scale B.

Then, the source controller 3 provides the high blue gray scale values BH, which are found from the lookup table according to the input blue gray scale values B, to the blue sub pixel 53 of one of the first pixel unit 5*a* and the second pixel unit 5*b*, as well as the source controller 3 provides the input red gray scale values R and the input green gray scale values G to the red sub pixel 51 and the green sub pixel 52 of one of the first pixel unit 5*a* and the second pixel unit 5*b*. In addition, the source controller 3 provides the low blue gray scale values BL, which are found from the lookup table according to the input blue gray scale values B, to the blue sub pixel 53 of the other of the first pixel unit 5*a* and the second pixel unit 5*b*, as well as the source controller 3 provides the input red gray scale values R and the input green gray scale values G to the red sub pixel 51 and the green sub pixel 52 of the other of the first pixel unit 5*a* and the second pixel unit 5*b*.

If the input video data are not within the video data intervals of the first predetermined complexion frame, the red gray scale values R are not within the intervals of red gray scale values (0.9*115, 1.1*115), and/or the green gray scale values G are not within the intervals of green gray scale values (0.9*82, 1.1*82) and/or the blue gray scale values B are not within the intervals of blue gray scale values (0.9*68, 1.1*68), then the source controller 3 directly provides the input video data (i.e. the red gray scale values R, the green gray scale values G and the blue gray scale values B) to each of the pixel units 5*a*, 5*b*.

In summary, according to the liquid crystal display panel and the driving method thereof of the disclosure, the input video data are transformed into high video data and low video data according to the predetermined complexion frame, and the high video data and the low video data are provided to the two adjacent pixel units, so that the visual effect of the liquid crystal display panel with a large view angle is improved in certain frame areas while remaining resolution and the signal unchanged when displaying other images. In addition, the problem of color shift when the view angle is too large is solved, the aperture ratio needs not to be lowered, and the performance of the liquid display panel is improved.

Although the present disclosure is illustrated and described with reference to specific embodiments, those skilled in the art will understand that many variations and modifications are readily attainable without departing from the spirit and scope thereof as defined by the appended claims and their legal equivalents.

What is claimed is:

1. A driving method of liquid crystal display panel, wherein the liquid crystal display panel comprises a plurality of display units, the display unit comprises two adjacent pixel units, the driving method comprising:

receiving input video data;

determining that whether the input video data are within a plurality of video data intervals of predetermined complexion frame;

if the input video data is within a certain video data intervals of predetermined complexion frame, then obtain high video data and low video data according to the input video data; and providing the high video data to one of the pixel units, and providing the low video data to the other pixel units;

wherein the liquid crystal display panel further comprises a lookup table, the lookup table comprises a plurality of video data, high video data and low video data, the high video data and the low video data are divided from the video data, the step of obtaining corresponding high video data and low video data according to the input video data is: obtaining corresponding high video data and low video data of the input video data by finding the lookup table according to the input video data.

2. The driving method of liquid crystal display panel according to claim 1, wherein if the input video data is not within any of the video data intervals of predetermined complexion frame, then provide the input video data to the pixel units.

3. The driving method of liquid crystal display panel according to claim 1, wherein the input video data comprise input red gray scale values, input green gray scale values and input blue gray scale values, the plurality of video data intervals of predetermined complexion frame comprises intervals of red gray scale values, intervals of green gray scale values and intervals of blue gray scale values;

wherein the input video data being within a certain video data interval of predetermined complexion frame indicates that: the input red gray scale value is within a certain red gray scale interval of predetermined complexion frame, the input green gray scale value is within a certain green gray scale interval of predetermined complexion frame, and the input blue gray scale value is within a certain blue gray scale interval of predetermined complexion frame.

4. The driving method of liquid crystal display panel according to claim 2, wherein the input video data comprise input red gray scale values, input green gray scale values and input blue gray scale values, the plurality of video data intervals of predetermined complexion frame comprises intervals of red gray scale values, intervals of green gray scale values and intervals of blue gray scale values;

wherein the input video data being not within any of the intervals of predetermined complexion frame indicates that: the input gray scale values of at least one color is not within any of the corresponding gray scale intervals of predetermined complexion frame.

5. The driving method of liquid crystal display panel according to claim 1, wherein the high video data and the low video data are divided from the video data according to Formula 1, $$\Delta(H, L) = \frac{\mathrm{abs}(Lv\alpha(H) + Lv\alpha(L) - Lv\alpha(T))}{Lv\alpha(T)}, \quad \text{[Formula 1]}$$

$$\Delta(H, L) < S,$$

$$e(H, L) = (x_\beta(H, L) - x_\alpha)^2 + (y_\beta(H, L) - y_\alpha)^2,$$

wherein obtain a minimum value from e(H,L), T indicates the video data, H indicates the high video data corresponding to the video data, L indicates the low video data corresponding to the video data, S indicates a predetermined threshold S, Lvα(H) indicates the corresponding brightness value of the image displayed by the video data T and the high video data H under a front view angle α, Lvα(L) indicates the corresponding brightness value of the image displayed by the video data T and the low video data L under the front view angle α, Lvα(T) indicates the brightness value of the image displayed by the video data T under the front view angle α, $x_\beta$(H,L) and $y_\beta$(H,L) indicate the chromaticity coordinates in CIE1931 system of the image displayed by the video data T under an oblique view angle β, as well as $x_\alpha$ and $y_\alpha$ indicates the chromaticity coordinates in CIE1931 system of the image displayed by the video data T under the front view angle α.

6. The driving method of liquid crystal display panel according to claim 5, wherein the range of the predetermined threshold S is between 0.05 and 0.1.

7. The driving method of liquid crystal display panel according to claim 5, wherein the front view angle α is 0°, and the oblique view angle β is between 30° and 80°.

8. The driving method of liquid crystal display panel according to claim 7, wherein the oblique view angle β is 60°.

9. A liquid crystal display panel, comprising a gate controller, a source controller and a pixel unit, the gate controller providing a scanning signal to the pixel unit by scan lines, the source controller providing a data signal to the pixel unit by data lines, wherein the driving method of the liquid crystal display panel comprises:

receiving input video data;

determining that whether the input video data are within a plurality of video data intervals of predetermined complexion frame;

if the input video data is within a certain video data intervals of predetermined complexion frame, then obtain high video data and low video data according to the input video data; and providing the high video data to one of the pixel units, and providing the low video data to the other pixel units;

wherein the liquid crystal display panel further comprises a lookup table, the lookup table comprises a plurality of video data, high video data and low video data, the high video data and the low video data are divided from the video data, the step of obtaining corresponding high video data and low video data according to the input video data is: obtaining corresponding high video data and low video data of the input video data by finding the lookup table according to the input video data.

10. The liquid crystal display panel according to claim 9, wherein if the input video data is not within any of the video data intervals of predetermined complexion frame, then provide the input video data to the pixel units.

11. The liquid crystal display panel according to claim 9, wherein the input video data comprise input red gray scale values, input green gray scale values and input blue gray scale values, the plurality of video data intervals of predetermined complexion frame comprises intervals of red gray scale values, intervals of green gray scale values and intervals of blue gray scale values;

wherein the input video data being within a certain video data interval of predetermined complexion frame indicates that: the input red gray scale value is within a certain red gray scale interval of predetermined complexion frame, the input green gray scale value is within a certain green gray scale interval of predetermined complexion frame, and the input blue gray scale value is within a certain blue gray scale interval of predetermined complexion frame.

12. The liquid crystal display panel according to claim 9, wherein the input video data comprise input red gray scale values, input green gray scale values and input blue gray scale values, the plurality of video data intervals of predetermined complexion frame comprises intervals of red gray scale values, intervals of green gray scale values and intervals of blue gray scale values;

wherein the input video data being not within any of the intervals of predetermined complexion frame indicates that: the input gray scale values of at least one color is not within any of the corresponding gray scale intervals of predetermined complexion frame.

13. The liquid crystal display panel according to claim 9, wherein the high video data and the low video data are divided from the video data according to Formula 1, $$\Delta(H, L) = \frac{\mathrm{abs}(Lv\alpha(H) + Lv\alpha(L) - Lv\alpha(T))}{Lv\alpha(T)}, \quad \text{[Formula 1]}$$

$$\Delta(H, L) < S,$$

$$e(H, L) = (x_\beta(H, L) - x_\alpha)^2 + (y_\beta(H, L) - y_\alpha)^2,$$

wherein obtain a minimum value from e(H,L), T indicates the video data, H indicates the high video data corresponding to the video data, L indicates the low video data corresponding to the video data, S indicates a predetermined threshold S, Lvα(H) indicates the corresponding brightness value of the image displayed by the video data T and the high video data H under a front view angle α, Lvα(L) indicates the corresponding brightness value of the image displayed by the video data T and the low video data L under the front view angle α, Lvα(T) indicates the brightness value of the image displayed by the video data T under the front view angle α, $x_\beta$(H,L) and $y_\beta$(H,L) indicate the chromaticity coordinates in CIE1931 system of the image displayed by the video data T under an oblique view angle β, as well as $x_\alpha$ and $y_\alpha$ indicates the chromaticity coordinates in CIE1931 system of the image displayed by the video data T under the front view angle α.

14. The liquid crystal display panel according to claim 13, wherein the range of the predetermined threshold S is between 0.05 and 0.1.

15. The liquid crystal display panel according to claim 13, wherein the front view angle α is 0°, and the oblique view angle β is between 30° and 80°.

16. The liquid crystal display panel according to claim 15, wherein the oblique view angle β is 60°.

* * * * *